US006802582B2

(12) United States Patent
Rupprecht et al.

(10) Patent No.: US 6,802,582 B2
(45) Date of Patent: Oct. 12, 2004

(54) INKJET PRINTING SYSTEM AND INKJET PRINTING PROCESS

(75) Inventors: Andreas Rupprecht, Mauer (DE); Clemens Rensch, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/195,192

(22) Filed: Jul. 15, 2002

(65) Prior Publication Data

US 2003/0011651 A1 Jan. 16, 2003

(30) Foreign Application Priority Data

Jul. 13, 2001 (DE) ..... 101 34 188

(51) Int. Cl.[7] ..... B41J 29/38
(52) U.S. Cl. ..... 347/10
(58) Field of Search ..... 347/9–11

(56) References Cited

U.S. PATENT DOCUMENTS 4,560,998 A * 12/1985 Wimmer ..... 347/9
5,265,315 A 11/1993 Hoisington et al. ..... 29/890.1

FOREIGN PATENT DOCUMENTS

| | | | | |
|---|---|---|---|---|
| DE | 198 03 467 A1 | | 8/1998 | |
| DE | 199 41 189 A1 | | 3/2000 | |
| DE | 199 11 399 A1 | | 9/2000 | |
| EP | 0271904 A2 | * | 6/1988 | ..... B41J/3/04 |
| JP | 10 128 970 A | | 5/1998 | |
| JP | 2001 010 043 A | | 1/2001 | |

* cited by examiner

*Primary Examiner*—Thinh Nguyen
(74) *Attorney, Agent, or Firm*—Laurence A. Greenberg; Werner H. Stemer; Gregory L. Mayback

(57) ABSTRACT

An inkjet printing system includes a configuration of nozzles, respectively having a nozzle chamber formed with a nozzle opening and provided with a respective piezoelectric element. A control device controls the piezoelectric elements. The control device has at least two signal paths switchable-on individually for each of the nozzles. An inkjet printing process uses at least part of the printing system.

7 Claims, 2 Drawing Sheets

INKJET PRINTING SYSTEM AND INKJET PRINTING PROCESS

BACKGROUND OF THE INVENTION

Field of the Invention

The invention relates to an inkjet printing system and an inkjet printing process performable with this system.

Inkjet printing systems are used in various ways in the printing industry. In these printing systems, tiny ink droplets are produced by computer-controlled nozzles, and applied to a printing material. In particular, systems wherein the nozzles are fitted with piezoelectric elements have been tried and tested. In these systems, all the piezoelectric elements are supplied with electrical signals by a common pulse generator, the individual piezoelectric elements, respectively, being switched on as a function of the imaging information to the pulse generator. Thus, all the nozzles that are not switched on do not output any ink droplets, and all the nozzles which are switched on output ink droplets of the same size. The simultaneous production of ink droplets of different sizes is consequently not possible with the heretofore known system of this general type, i.e., different gray values cannot be printed at the same time with the heretofore known system.

In order to display different gray values, in the case of the heretofore known system, it is necessary for the nozzles to be activated repeatedly at short time intervals or for the printing material to be guided repeatedly past the same nozzle arrangement or for a plurality of nozzle arrangements to be positioned in tandem, i.e., behind one another.

The heretofore known inkjet printing system thus has the disadvantage that always only one droplet size and, consequently, also only one gray value can be produced simultaneously by the nozzles. In other words, although it is possible to control all the nozzles individually and it is also possible to vary the control signal and, therefore, the droplet size, a limitation or restriction exists in that all the nozzles controlled at the same time are controlled with the identical signal, and therefore identical droplet sizes are also produced. At another time, a different droplet size can be produced, but this is in turn identical for all the nozzles controlled at this different time.

U.S. Pat. No. 5,265,315 discloses a method of producing a thin-layer inkjet head. By the heretofore known method, an electrode arrangement is produced which, as can be seen from the drawing, appears to have a plurality of electrodes for each nozzle. The question, however, as to whether these are definitely separate electrodes or whether the electrodes are interconnected is left open in this document. Also left open is the question as to which functions are given to this specific electrode arrangement and how the electrodes are controlled in detail.

SUMMARY OF THE INVENTION

It is accordingly an object of the invention to provide an inkjet printing system and an inkjet printing process which has greater flexibility with respect to the size of the ink droplets produced, respectively, than heretofore possible with conventional inkjet printing systems.

With the foregoing and other objects in view, there is provided, in accordance with one aspect of the invention, an inkjet printing system comprising an arrangement of nozzles, respectively, having a nozzle chamber formed with a nozzle opening and provided with a respective piezoelectric element, and a control device for controlling the piezoelectric elements, the control device having at least two signal paths switchable-on individually for each of the nozzles.

In accordance with another feature of the invention, each of the piezoelectric elements has at least two control electrodes individually controllable by the control device.

In accordance with a further feature of the invention, the control electrodes of the same piezoelectric element are of different construction, so that ink droplets of different sizes are producible with an identical signal.

In accordance with an added feature of the invention, the control electrodes of the same piezoelectric element are arranged in a non-equivalent manner, so that ink droplets of different sizes are producible with an identical signal.

In accordance with an additional feature of the invention, the control device has a plurality of signal sources corresponding to the number of signal paths for each nozzle, each of the signal sources serving for producing different signals.

In accordance with yet another feature of the invention, the control device has at least one signal source and at least one modifier circuit for modifying the signals provided by the signal source.

In accordance with yet a further feature of the invention, the inkjet printing system further comprises a modifier circuit assigned to at least one signal path, respectively, for each of the nozzles.

In accordance with yet an added feature of the invention, the modifier circuit is constructed as an RC element.

In accordance with yet an additional feature of the invention, the control device has a switch matrix for switching-on the signal paths to the piezoelectric elements.

In accordance with another aspect of the invention, there is provided an inkjet printing process for printing with ink droplets on a printing material, which comprises providing an arrangement of nozzles for producing the ink droplets, providing a control device for controlling piezoelectric elements assigned to the nozzles, and controlling with the control device a respective piezoelectric element in order to produce an ink droplet, by switching-on at least one of at least two signal paths provided individually for controlling the respective piezoelectric element.

In accordance with another mode, the process of the invention further comprises controlling with the control device at least one of at least two electrodes of the piezoelectric element based upon the respectively desired size of the ink droplet.

In accordance with a concomitant mode, the process of the invention further comprises controlling the piezoelectic element with the control device by a signal which is prescribed based upon the respectively desired size of the ink droplet.

The inkjet printing system according to the invention comprises an arrangement of nozzles each having a nozzle chamber formed with a nozzle opening and provided with a piezoelectric element. Furthermore, the inkjet printing system according to the invention has a control or driving device having at least two signal paths which are switchable-on individually for each nozzle.

The inkjet printing system according to the invention offers the advantage that, in relation to nozzles controlled at the same time, ink droplets can be produced in at least two different sizes, depending upon which signal path, respectively, of the control device is switched.

In a preferred embodiment, each piezoelectric element has at least two control electrodes, which are driven individually by the control or drive device. This provides the advantage that the production of different droplet sizes can be implemented or realized in many different ways.

One possible realization calls for the control electrodes of the same piezoelectric element to be constructed differently, so that ink droplets of different sizes can be produced with an identical signal. This has the advantage that only one signal source is required in order to drive the inkjet printing system.

Furthermore, the control electrodes of the same piezoelectric element can be arranged in a non-equivalent manner. This measure also permits the production of ink droplets of different sizes with one and the same signal.

In a second embodiment of the inkjet printing system according to the invention, it is sufficient for each piezoelectric element to have a single control electrode. In this embodiment, the control device has a plurality of signal sources corresponding to the plurality of signal paths for each piezoelectric element, each signal source producing different signals. This embodiment offers the advantage that conventional nozzles with one control electrode for each piezoelectric element can be used.

In a third embodiment of the inkjet printing system according to the invention, the control device has at least one signal source and at least one modifier circuit for modifying the signals provided by the signal source. This embodiment has the advantage that it needs only one signal source. Nevertheless, in the case of this embodiment, analogous with the second embodiment, nozzles with a single control electrode can be used.

The third embodiment can, in particular, also be constructed so that, respectively, one modifier circuit is assigned to at least one signal path per nozzle.

The modification circuit is preferably realized or implemented as an RC element or component.

In all of the embodiments of the inkjet printing system according to the invention, the control device can have a switch matrix for switching on the signal paths to the piezoelectric elements. The use of a switch matrix has the advantage that it can be implemented compactly and cost-effectively.

The inkjet printing process according to the invention provides for producing, by an arrangement of nozzles, ink droplets for printing a printing material, and controlling, by a control device, the piezoelectric elements assigned to the nozzles. In this regard, the control device controls the appropriate piezoelectric element, respectively, in order to produce an ink droplet, by switching on at least one of at least two signal paths provided individually for controlling this piezoelectric element.

In a preferred modification, the process includes controlling, by the control device, at least one of at least two electrodes of the piezoelectric element, based upon the respectively desired size of the ink droplet.

In a further modification, the process includes controlling the piezoelectric element, by the control device, with a signal which is prescribed or predefined based upon the respectively desired size of the ink droplet.

Other features which are considered as characteristic for the invention are set forth in the appended claims.

Although the invention is illustrated and described herein as embodied in an inkjet printing system and an inkjet printing process, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
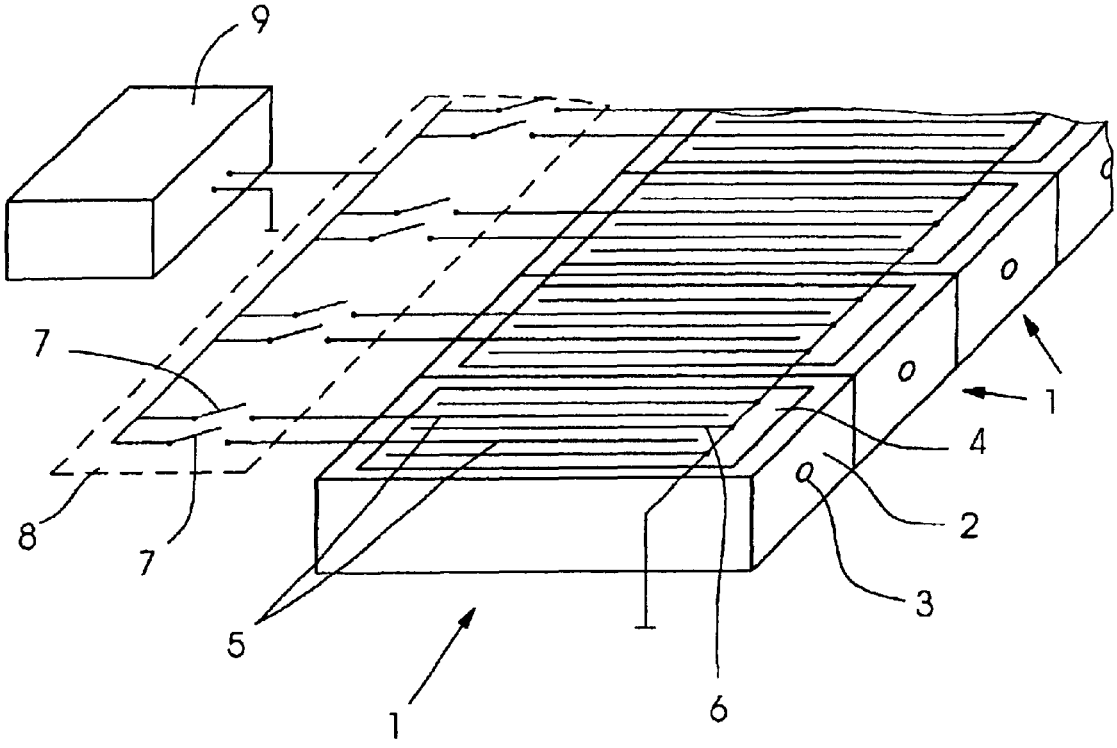
FIG. 1 is a diagrammatic perspective view or basic sketch of a preferred first embodiment of the inkjet printing system according to the invention.

Referring now to the drawings and, first, particularly to FIG. 1 thereof, there is shown therein, in a basic sketch, a perspective view of a preferred embodiment of the inkjet printing system according to the invention. The inkjet printing system has a large number of nozzles 1 lined up in a row, all of which are of identical construction. Each nozzle 1 has a nozzle chamber 2 filled with printing ink and formed with a nozzle opening 3. In addition, each nozzle 1 has a piezoelectric element 4 with two control electrodes 5 and a ground electrode 6, which engage or mesh fingerlike in one another. All the ground electrodes 6 of all the nozzles 1 are connected to ground via a common ground line. Each control electrode 5 is connected via its own line to a respective switch element 7 of a switch matrix 8, shown in broken lines. The switch elements 7, for their part, are respectively connected to an output of a pulse generator 9. A further output from the pulse generator 9 is connected to ground.

In order to arrange for a specific nozzle 1 to output an ink droplet, the switch matrix 8 switches on a signal path from the pulse generator 9 to one of the control electrodes 5 of the nozzle 1, i.e., the switch element 7 connected upstream of the control electrode 5 is closed. As a result, the signal generated by the pulse generator 9 is fed to the control electrode 5. The signal applied to the control electrode 5, in conjunction with the ground electrode 6, generates an electric field in the piezoelectric element 4. The electric field causes deformation of the piezoelectric element 4, which ultimately effects the output of an ink droplet through the nozzle opening 2.

According to the process outlined hereinbefore, any nozzle 1 can arbitrarily be arranged to output an ink droplet independently of all the other nozzles 1, i.e., the respective nozzle 1 can output an ink droplet singly or at the same time as other nozzles 1 are outputting respective ink droplets. In order to produce a printed image, the switch matrix 8 is controlled in a manner based upon the imaging information and, therefore, the output of ink droplets by the nozzles 1 is influenced in such a manner that ultimately the desired printed image is produced.

The embodiment illustrated in FIG. 1 offers further functionality in addition to the independent switching-on of the signal source 9 to each arbitrary nozzle 1. In this regard, this additional functionality is the capability of predefining or prescribing the size of the ink droplet output individually at any time for each nozzle 1, i.e., independently of the droplet size produced by other nozzles 1 at the same time. This is rendered possible by the fact that the size of the ink droplets produced depends, respectively, upon which of the two control electrodes 5 of the respective nozzle 1 is being controlled or whether one or both control electrodes 5 of the respective nozzle 1 are being controlled.

In order to produce different droplet sizes, the two control electrodes 5 of the nozzle 1 can be constructed differently from one another. The control electrodes 5 can, for example, cover or have an effect upon different areas of the piezoelectric element 4, so that when the control electrodes 5 are controlled with an identical signal, the piezoelectric element 4 is deformed differently and, therefore, ink droplets of different sizes are produced. Depending upon whether the switch matrix 8 switches on a signal path from the pulse generator 9 to one or the other control electrode 5, it is therefore possible for a small or a large ink droplet to be produced. In this case, there is no restriction or limitation with regard to the switch-on action, i.e., for each individual nozzle 1, it is possible to predefine or prescribe individually whether it is to output just a small or a large or even no ink droplet at all. The droplet size and, consequently, the printed gray value, is able, therefore, to be controlled individually for all of the nozzles 1.

A further possible way of producing different droplet sizes is to arrange the control electrodes 5 in positions of the piezoelectric element 4 which are non-equivalent, so that controlling the individual control electrodes 5, in turn, leads to different deformations of the piezoelectric element 4 and, therefore, to different droplet sizes.

If the two gray values which can be produced in the aforedescribed manner are inadequate for an application, in principle, even more than two control electrodes 5 can be provided for each piezoelectric element 4 and, therefore, for each nozzle 1. Accordingly, the number of droplet sizes and gray values, respectively, which can be produced is increased. Further gray values and droplet sizes, respectively, can also be produced by simultaneously controlling a plurality of control electrodes 5 within one nozzle 1. Thus, for example, in the case of two control electrodes 5 for each nozzle 1, an additional droplet size results. In addition, the possibility arises of constructing all the control electrodes 5 of a nozzle 1 identically, and the droplet size is varied by the number of control electrodes 5 which are driven simultaneously in a nozzle 1.

Figure 2:
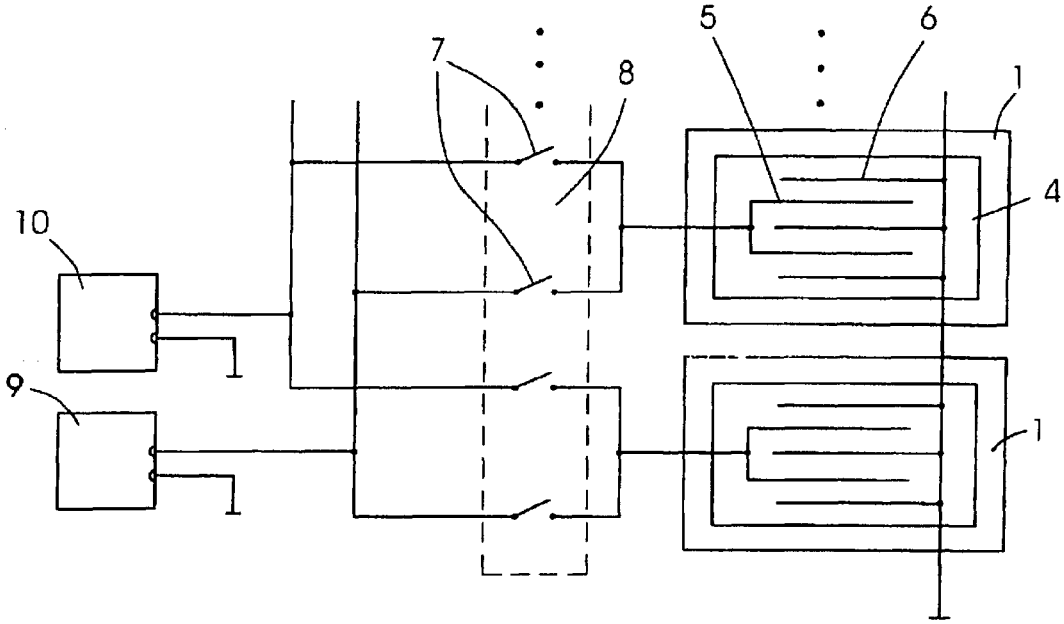
FIG. 2 is a diagrammatic plan view of a second embodiment of the inkjet printing system according to the invention.

FIG. 2 is a diagrammatic illustration of a second embodiment of the inkjet printing system according to the invention. This embodiment differs from the embodiment according to FIG. 1 in particular in that for each nozzle 1 there is only one control electrode 5. This second embodiment can therefore be implemented or realized with nozzles 1 of conventional construction. As is explained in the hereinafter following text, in the case of the second embodiment, there is the possibility of predefining or prescribing the droplet size individually for each nozzle 1 via the selection of the control signal.

The second embodiment, which is illustrated in FIG. 2, corresponds to the embodiment according to FIG. 1 with regard to the arrangement and the basic construction of the nozzles 1. These details are therefore not illustrated again in FIG. 2. However, there is a significant difference with regard to the control electrodes 5. For each nozzle 1, respectively, in the second exemplary embodiment, there is only one control electrode 5, which is connected, respectively, to two switch elements 7 of the switch matrix 8. One of the two switch elements 7, respectively, is connected to the output of the pulse generator 9. The respective other switch element 7 is connected to an output of a further pulse generator 10, which supplies a different signal than that of the pulse generator 9, for example, a signal with a smaller amplitude or another signal form. A further output of the further pulse generator 10 is connected to ground, just like the further output of the pulse generator 9.

With the arrangement illustrated in FIG. 2, a large number of different signal paths from the two pulse generators 9 and 10 can be switched through to the individual nozzles 1, the appropriate switch elements 7, respectively, being closed. In particular, a signal path from each of the two pulse generators 9 and 10 can be switched through to each nozzle 1, i.e., a signal from the pulse generator 9 or a signal from the further pulse generator 10 being selectively applicable to each nozzle 1. Because the signals produced by the two pulse generators 9 and 10 are different, the nozzle 1 produces ink droplets of different size, depending upon which of the pulse generators 9 or 10 is switched through to the nozzle 1. With the inkjet printing system illustrated in FIG. 2, it is therefore, respectively, possible for one of two droplet sizes that can be selected individually for each nozzle 1 to be produced at the same time by any desired nozzle 1.

When the two pulse generators 9 and 10 have been carefully tuned to one another, it is further possible for yet a third droplet size to be produced, by switching the respective nozzle 1 through simultaneously to both pulse generators 9 and 10, so that the signals for this nozzle 1 output by the two pulse generators 9 and 10 are superimposed and, as a result, effect the output of ink droplets of a third size.

Furthermore, in a non-illustrated modification of the second embodiment, additional pulse generators can be provided for producing additional droplet sizes. The additional pulse generators are wired to a corresponding number of additional switching elements 7 for each nozzle 1, so that each pulse generator is connected via one switching element 7, respectively, to each nozzle 1 and, therefore, respectively, one signal path can be switched through individually from each pulse generator to each nozzle 1. Consequently, this modified embodiment has one switching element 7 per pulse generator for each nozzle 1, and permits each nozzle 1 to be controlled with the signal from any desired pulse generator or also from a plurality of pulse generators.

Figure 3:
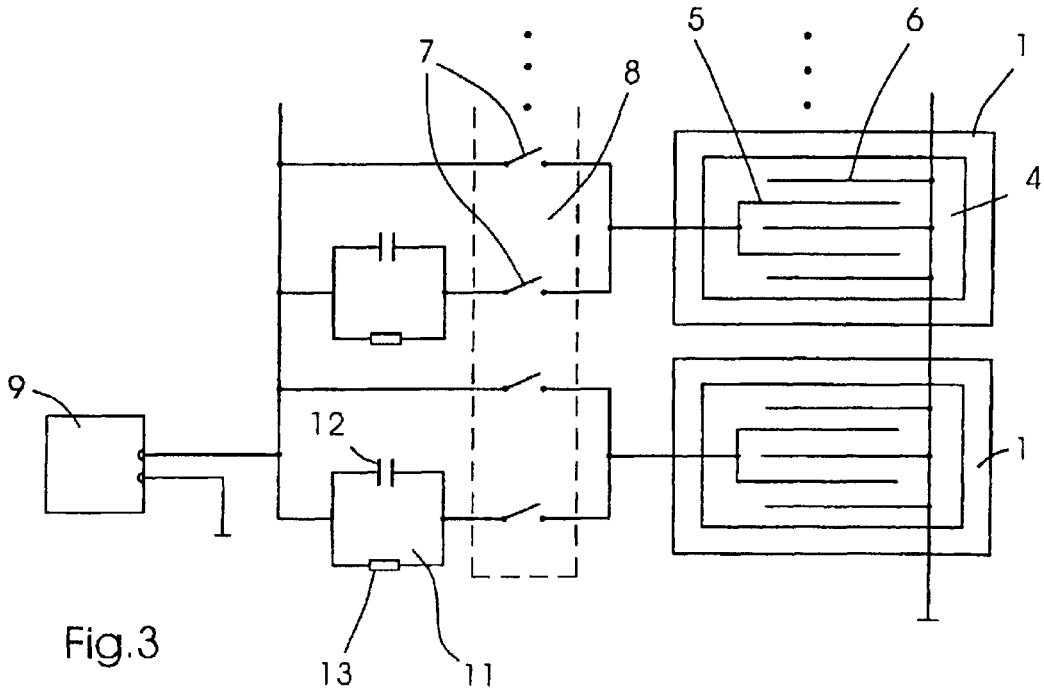
FIG. 3 is a view like that of FIG. 2 of a third embodiment of the inkjet printing system according to the invention.

FIG. 3 is a diagrammatic illustration of a third embodiment of the inkjet printing system according to the invention. This embodiment largely corresponds to the second embodiment illustrated in FIG. 2, i.e., each nozzle 1 has only one control electrode 5 and is connected to two switch elements 7. In contrast with the second embodiment, however, the third embodiment has only one pulse generator 9. A further difference is that RC (resistor/capacitor) elements 11 are present as additional elements or components. The RC elements 11 have a capacitor 12 and a purely resistive resistor 13, which are connected in parallel with one another. One RC element 11, respectively, is connected in series with one of the two switch elements 7 for each nozzle 1, so that this switch element 7, respectively, is connected to the pulse generator 9 via the RC element 11. The other switch element 7, respectively, is connected directly to the pulse generator 9. For each nozzle 1, the third embodiment therefore likewise has two signal paths which can be switched through individually, respectively, a direct connection between the pulse generator 9 and the control electrode 5 of the nozzle 1 being produced by one signal path, and the pulse generator 9, respectively, being connected by the other signal path to the control electrode 5 of the nozzle 1 via the RC element 11. In this regard, both signal paths, respectively, have a switch element 7 with which the signal paths, respectively, can be switched through individually.

The interposition or interconnection of the RC element 11, respectively, has the effect of modifying the signal on the path thereof from the pulse generator 9 to the control electrode 5, i.e., different signals are applied to the control electrode 5 of the nozzle 1, depending upon whether a signal path with or without an RC element 11 is switched through. As explained many times hereinbefore, these different signals have the effect of producing ink droplets of different size. Thus, with this embodiment, it is also possible to produce different droplet sizes individually for each nozzle 1.

In analogy with the second embodiment, a signal path without an RC element 11 and a signal path with an RC element 11 can be switched through simultaneously to the same nozzle 1, so that two different signals are applied simultaneously to the control electrode 5 of the nozzle 1. As a result, a further droplet size can be produced.

Furthermore, it is also possible to increase the number of RC elements 11 for each nozzle 1 and, in a corresponding manner, the number of switch elements 7 for each nozzle 1, in order to provide a greater number of different control signals and, consequently, to permit a greater variety of droplet sizes. In this regard, one additional RC element 11, respectively, is arranged in series with each additional switch element 7, and this series circuit is connected in parallel with the signal paths already present.

In principle, it is also possible, in the case of the third embodiment, to provide only a single RC element 11 overall, which is connected on one side to the signal source 9 and on the other side to each one of the two switch elements 7 for each nozzle 1 or, in the case of more than two switch elements 7 for each nozzle 1, to provide a correspondingly greater number of RC elements 9 wired in such a manner. This one RC element 11 then performs the function of the further pulse generator 10 in the case of the second embodiment, or the plurality of RC elements 11 perform the function of the additional pulse generators according to a modified version of the second embodiment.

In all the embodiments, the pulse generator 9 and the pulse generators 9 and 10, respectively, and, if appropriate, further pulse generators can also be arranged externally, i.e., each pulse generator is replaced by a signal input, to which a signal produced outside the inkjet printing system according to the invention is applied.

Furthermore, the piezoelectric element 4 does not necessarily have to represent a spatially continuous or coherent unit. It can also be formed of a plurality of partial elements, all the partial elements of a nozzle 1 then being designated overall as a piezoelectric element 4. The significance thereof is, for example, that a piezoelectric element 4 with a plurality of control electrodes 5 can be implemented or realized as an arrangement of a plurality of partial elements within a nozzle 1, each having a control electrode 5.

Instead of the aforedescribed RC elements, RC elements constructed in other ways or also other circuits can be used for modifying the signals.

We claim:

1. An inkjet printing system, comprising:

a configuration of nozzles each having a respective nozzle chamber formed with a nozzle opening and provided with a respective piezoelectric element, each of said piezoelectric elements having at least two control electrodes; and a control device for controlling said piezoelectric elements, said control device individually controlling said at least two control electrodes, said control device having at least two signal paths to be switched-on individually for each of said nozzles, said control electrodes of a respective one of said piezoelectric elements having different constructions, permitting ink droplets of different sizes to be produced with an identical signal.

2. An inkiet printing system, comprising:

a configuration of nozzles each having a respective nozzle chamber formed with a nozzle opening and provided with a respective piezoelectric element, each of said piezoelectric elements having at least two control electrodes; and a control device for controlling said piezoelectric elements, said control device individually controlling said at least two control electrodes, said control device having at least two signal paths to be switched-on individually for each of said nozzles, said control electrodes of a respective one of said piezoelectric elements being disposed in a non-equivalent manner, permitting ink droplets of different sizes to be produced with an identical signal.

3. An inkjet printing system, comprising:

a configuration of nozzles each having a respective nozzle chamber formed with a nozzle opening and provided with a respective piezoelectric element; and a control device for controlling said piezoelectric elements, said control device having at least two signal paths to be switched-on individually for each of said nozzles, said control device having at least one signal source and at least one modifier circuit provided in at least one of said at least two signal paths for modifying signals provided by said signal source.

4. An inkjet printing system, comprising:

a configuration of nozzles each having a respective nozzle chamber formed with a nozzle opening and provided with a respective piezoelectric element; and a control device for controlling said piezoelectric elements, said control device having at least two signal paths to be switched-on individually for each of said nozzles, said control device having at least one signal source and at least one modifier circuit for modifying signals provided by said signal source;

said modifier circuit being assigned to at least one respective signal path for each of said nozzles, said modifier circuit being an RC element.

5. An inkjet printing system, comprising:

a configuration of nozzles each having a respective nozzle chamber formed with a nozzle opening and provided with a respective piezoelectric element; and a control device for controlling said piezoelectric elements, said control device having at least two signal paths to be switched-on individually for each of said nozzles, said control device having at least one signal source and at least one modifier circuit for modifying signals provided by said signal source, said modifier circuit being an RC element.

6. An inkjet printing system, comprising:

a configuration of nozzles each having a respective nozzle chamber formed with a nozzle opening and provided with a respective piezoelectric element; and a control device for controlling said piezoelectric elements, said control device having at least two signal paths to be switched-on individually for each of said nozzles, said control device having a plurality of signal sources corresponding to a number of signal paths for each of said nozzles, and each of said signal sources serving for producing different signals.

7. An inkjet printing process for printing with ink droplets on a printing material, the method which comprises:

providing a configuration of nozzles for producing the ink droplets;

providing a control device for controlling piezoelectric elements assigned to the nozzles;

providing the control device with a plurality of signal sources corresponding to a number of signal paths for each of the nozzles, each of the signal sources serving for producing different signals; and controlling with the control device a respective piezoelectric element to produce an ink droplet, by individually switching-on at least one of at least two signal paths provided individually for controlling the respective piezoelectric element.

* * * * *